US012296232B2

(12) United States Patent
Zhang

(10) Patent No.: US 12,296,232 B2
(45) Date of Patent: May 13, 2025

(54) SYSTEM AND METHOD FOR ATTACHING A REBOUND MAT TO A TRAMPOLINE FRAME

(71) Applicant: Suzhou Innovative Sports Goods Co., Ltd., Jiangsu Province (CN)

(72) Inventor: Rongliang Zhang, KL (HK)

(73) Assignee: Suzhou Innovative Sports Goods Co. Ltd. (CN)

( * ) Notice: Subject to any disclaimer, the term of this patent is extended or adjusted under 35 U.S.C. 154(b) by 107 days.

(21) Appl. No.: 18/156,344

(22) Filed: Jan. 18, 2023

(65) Prior Publication Data

US 2024/0238634 A1 Jul. 18, 2024

(51) Int. Cl.

| | |
|---|---|
| ***A63B 5/11*** | (2006.01) |
| ***A63B 21/00*** | (2006.01) |
| ***A63B 21/04*** | (2006.01) |
| ***A63B 21/055*** | (2006.01) |

(52) U.S. Cl.

CPC ..... *A63B 5/11* (2013.01); *A63B 21/0428* (2013.01); *A63B 21/0557* (2013.01); *A63B 21/154* (2013.01)

(58) Field of Classification Search

CPC ... A63B 5/11; A63B 21/0428; A63B 21/0557; A63B 21/154

See application file for complete search history.

(56) References Cited

U.S. PATENT DOCUMENTS

| | | | | |
|---|---|---|---|---|
| 2,991,841 | A | 7/1961 | Sampson et al. | |
| 6,053,845 | A * | 4/2000 | Publicover | A63B 71/023 482/28 |
| 10,532,238 | B2 | 1/2020 | Publicover et al. | |
| D941,414 | S * | 1/2022 | Zeng | D21/797 |
| 2005/0137061 | A1* | 6/2005 | Wang | A63B 5/11 482/28 |
| 2009/0291806 | A1* | 11/2009 | Publicover | A63B 5/11 482/27 |
| 2013/0316875 | A1 | 11/2013 | Howell | |
| 2016/0271436 | A1* | 9/2016 | Heymans | A63B 5/11 |

(Continued)

FOREIGN PATENT DOCUMENTS

| | | |
|---|---|---|
| CN | 110792727 | 2/2020 |
| DE | 10226707 | 1/2004 |

(Continued)

*Primary Examiner* — Megan Anderson

*Assistant Examiner* — Andrew M Kobylarz

(74) *Attorney, Agent, or Firm* — LaMorte & Associates PC

(57) ABSTRACT

A system and method for attaching a rebound mat to a peripheral frame using elastic loops. Each of the elastic loops has a first section and a second section that can be stretched in opposite directions. A loop connector is used to interconnect the two stretched loop sections. The loop connector has a first pulley wheel, a second pulley wheel, and a gap space. The first section of the elastic loop is extended through or around a feature of the peripheral frame. The second section is extended through or around a feature of the rebound mat. Once engaged with the loop connector, the first section of the elastic loop rests upon the first pulley wheel and the second section of the elastic loop rests upon the second pulley wheel. As the elastic loop stretches and contracts, the elastic loop rotates the pulley wheels, therein limiting the wear.

18 Claims, 5 Drawing Sheets

(56) References Cited

U.S. PATENT DOCUMENTS

| | | | | |
|---|---|---|---|---|
| 2016/0310774 | A1 | 10/2016 | Publicover et al. | |
| 2018/0353789 | A1* | 12/2018 | Tseng | A63B 1/00 |
| 2019/0154115 | A1* | 5/2019 | Mehr | A63B 5/11 |

FOREIGN PATENT DOCUMENTS

| | | |
|---|---|---|
| DE | 10 2016 104 782 | 4/2019 |
| FI | 128817 | 12/2020 |
| WO | WO 2018/081836 | 5/2018 |

* cited by examiner

SYSTEM AND METHOD FOR ATTACHING A REBOUND MAT TO A TRAMPOLINE FRAME

BACKGROUND OF THE INVENTION

1. Field of the Invention

In general, the present invention relates to the structure of recreational trampolines and similar rebound assemblies. More particularly, the present invention relates to systems that are used to interconnect a centralized rebound mat to an outer support framework.

2. Prior Art Description

There are many types of trampolines and rebound assemblies. For example, there are trampolines that people jump upon and there are rebound assemblies used to rebound balls. A common type of trampoline is the recreational trampoline that is traditionally erected in the yard of a home. A common type of rebound assembly is a pitch-back rebounder that is used to return thrown baseballs, lacrosse balls and the like. Such a rebound assembly is also typically erected in the yard of home. Both recreational trampolines and rebound assemblies have a rebound mat that is traditionally circular or rectangular. The rebound mat itself is made from synthetic material that can withstand exposure to the sun and weather. The periphery of the rebound mat is attached to a frame ring. The frame ring is supported by legs that hold the frame ring and the rebound mat above the ground. The bounce of the trampoline or rebound assembly is provided by the connectors that are used to attach the rebound mat to the frame ring.

In the prior art, there are two primary techniques that are used to attach the periphery of a rebound mat to a surrounding frame ring. In the first technique, metal springs are used. Each of the metal springs has a hook at one end that attaches to the rebound mat and a hook at the opposite end that attaches to the frame ring. Such connection techniques are exemplified by U.S. Patent Application Publication No. 2009/0291806 to Publicover.

Metal springs have a tendency to rust over time. Likewise, metal springs experience metal fatigue and can deform if hyperextended. All of these conditions can cause a metal spring to eventually break. Once the spring has failed, the broken edge of the metal spring can be sharp and can become a contact hazard to any person bouncing on a trampoline. Furthermore, the coils of metal springs separate and contract as a person jumps on the trampoline or as balls contact the rebound assembly. The coils of the spring can therefore catch hair, fingers, and clothing on any person who may be in contact with the spring while the trampoline or rebound assembly is in use. Such spring pinching events are commonplace on trampolines if more than one person is using the trampoline at the same time. It is for these reasons that trampoline manufacturers have been transitioning away from the use of metal springs.

In the second technique used to attach a rebound mat to a frame ring, elastic cords are used in place of metal springs. A plurality of elastic cords are stretched in between the periphery of the rebound mat and the surrounding frame ring. Hooks or loops are provided on the periphery of the rebound mat that are engaged by the elastic cords. The elastic cords are then typically looped around the outside diameter of the frame ring to engage the frame ring. Such prior art attachment techniques are exemplified by German Patent DE 10226707 to Kunhardt and U.S. Pat. No. 10,532,238 to Publicover.

Elastic cords are made of elastic polymers that degrade when exposed to UV radiation. Thus, elastic cords slowly degrade as they are exposed to sunlight. Furthermore, elastic cords have the tendency to fray as they wear against surfaces. As the elastic cords fray, more of the elastic polymers become exposed and the faster the elastic polymer degrades. Eventually, the elastic cords lose their ability to stretch and retract. Accordingly, in order for the trampoline to function properly and remain safe, the elastic cords must be periodically replaced.

A need therefore exists for an improved attachment system for connecting a rebound mat to a frame ring that uses elastic cords, but does so in a way that minimizes wear to the elastic cords and extends the operational periods between replacements. This need is met by the present invention as described and claimed below.

SUMMARY OF THE INVENTION

The present invention is a system and method for attaching a rebound mat to a peripheral frame using a plurality of elastic loops. Each of the elastic loops has a first section and a second section that can be stretched in opposite directions. A loop connector is used to interconnect the two stretched loop sections. The loop connector has a first pulley wheel, a second pulley wheel, and a gap space that is disposed between the first pulley wheel and the second pulley wheel.

The first section of the elastic loop is extended through or around a feature of the peripheral frame ring. Likewise, the second section of the elastic loop is extended through or around a feature of the rebound mat. The first section of the elastic loop is attached to the second section of the elastic loop at a point between the rebound mat and the frame ring. Once engaged with the loop connector, the first section of the elastic loop rests upon the first pulley wheel and the second section of the elastic loop rests upon the second pulley wheel. As the elastic loop stretches and contracts, the elastic loop rotates the pulley wheels, therein limiting the wear stresses experienced by the elastic loop.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system and methodology can be embodied in many ways, only two exemplary embodiments are illustrated. The exemplary embodiments are being shown for the purposes of explanation and description. The exemplary embodiments are selected in order to set forth two of the best modes contemplated for the invention. The illustrated embodiments, however, are merely exemplary and should not be considered as limitations when interpreting the scope of the appended claims.

Figure 1:
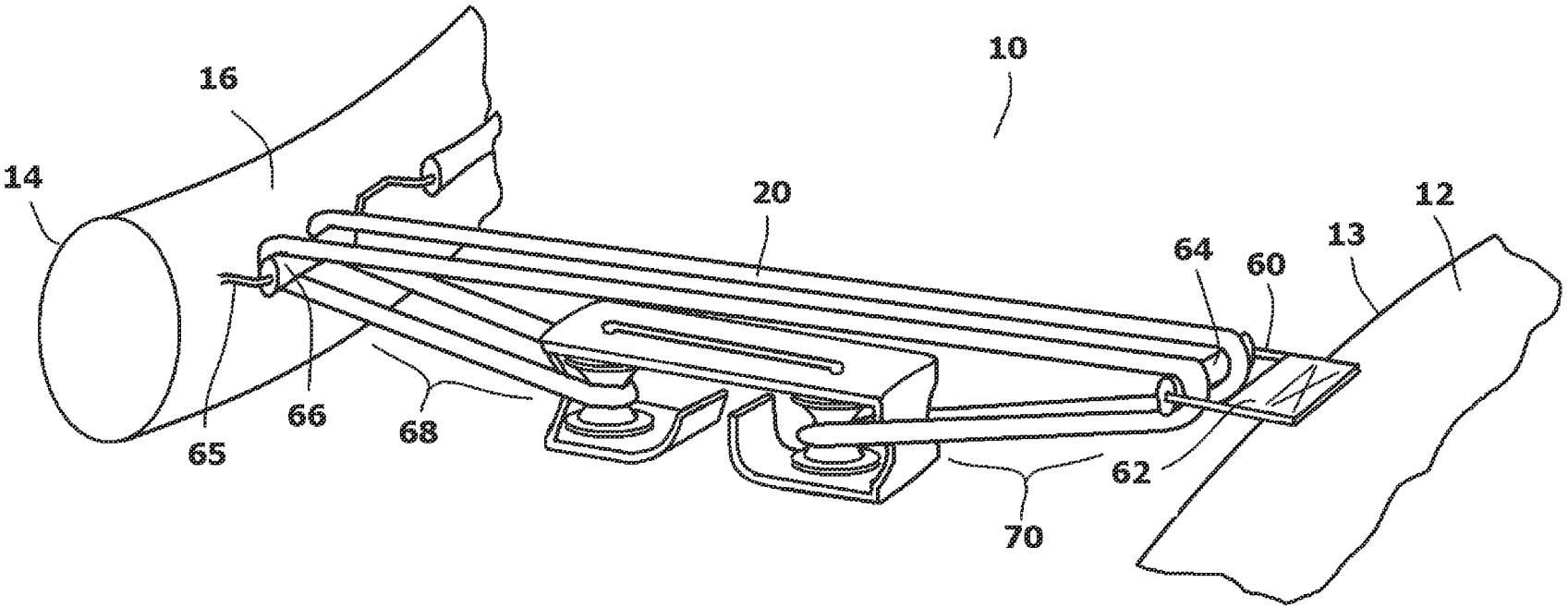
FIG. 1 shows a segment of a trampoline assembly embodying a first exemplary embodiment of the present invention.

Referring to FIG. 1 a segment of a trampoline 10 is shown. It will be understood that the trampoline 10 illustrated is intended to be indicative of all trampolines and rebound assemblies that use the construction described. The trampoline 10 has a rebound mat 12. The rebound mat 12 is held at an elevation by a stationary framework 14. The stationary framework 14 as a frame ring 16 that surrounds the periphery 13 of the rebound mat 12. The frame ring 16 is supported by legs that hold the frame ring 16 and the rebound mat 12 at an elevation. In the shown embodiment, the rebound mat 12 and the frame ring 16 are booth circular. Such a configuration is exemplary, and it will be understood that alternate geometric shapes, such as rectangular shapes, can be used.

Elastic loops 20 are used to interconnect the periphery 13 of the rebound mat 12 to the frame ring 16. The elastic loops 20 are closed loops that have a circular shape when unstretched. The elastic loops 20 can be made from rubber but are preferably made from elastic cord. That is, the elastic loops 20 are made from a plurality of elastic strands wrapped within a protective sheath in the manner of a bungee cord. The rebounding force provided by the elastic loops 20 depends upon the length of the elastic loops 20, the diameter of the elastic loops 20, and the condition of the elastic loops 20. As will be explained in greater detail, the opposite end of each of the elastic loops 20 are interconnected using a unique loop connector assembly 22.

Figure 2:
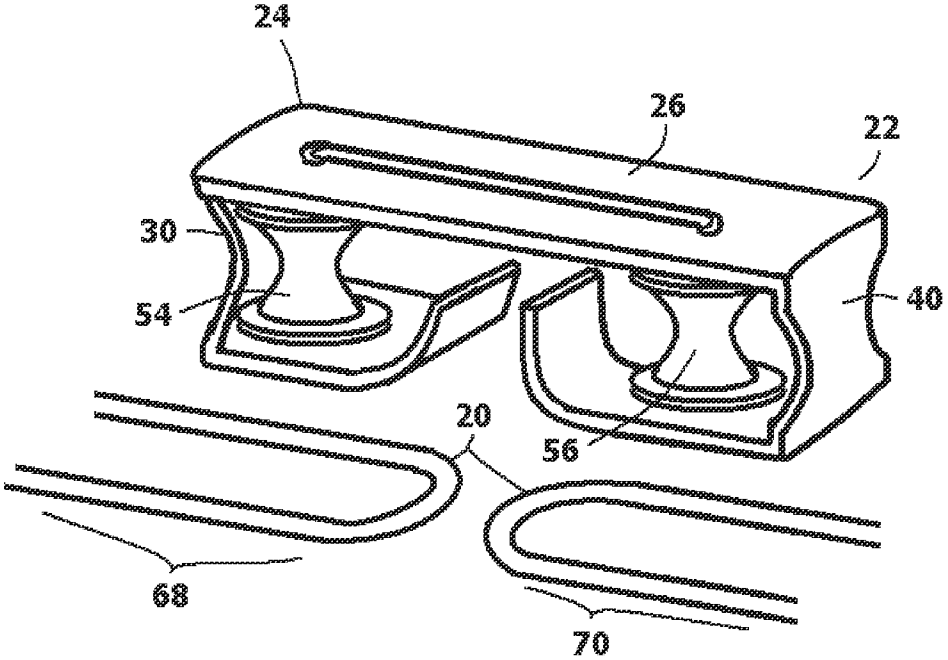
FIG. 2 is an isolated view of the connector assembly used in FIG. 1.
Figure 3:
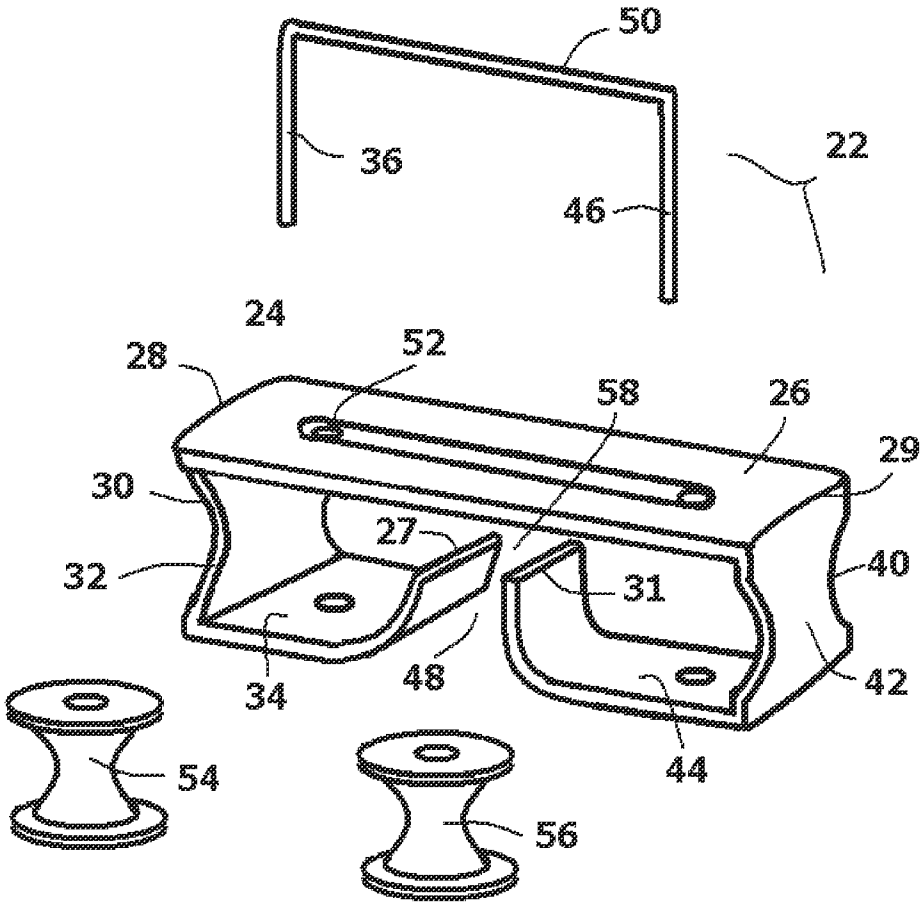
FIG. 3 is an exploded view of the connector assembly of FIG. 2.

Referring to FIG. 2 and FIG. 3 in conjunction with FIG. 1, the details of the loop connector assembly 22 are detailed. The loop connector assembly 22 is designed to interconnect opposite sections of an elastic loop 20 in a manner that minimizes wear forces experienced by the elastic loop 20. The loop connector assembly 22 has a bracket 24. The bracket 24 has a crossbar 26 with a first end 28 and an opposite second end 29. A first generally J-shape arm 30 extends from the first end 28 of the crossbar 26. The first J-shaped arm 30 has a first stem section 32 and a first foot section 34. The first stem section 32 is perpendicular to the crossbar 26. The first foot section 34 is generally parallel to the crossbar 26 with the exception of a flared free end 27. A first axle 36 extends from the crossbar 26 to the first foot section 34, wherein the first axle 36 is parallel to the first stem section 32 and perpendicular to the crossbar 26.

A second J-shape arm 40 extends from the second end 29 of the crossbar 26 and is the mirror image of the first J-shaped arm 30. The second J-shaped arm 40 has a second stem section 42 and a second foot section 44. The second stem section 42 is perpendicular to the crossbar 26. The second foot section 44 is mostly parallel to the crossbar 26 with the exception of a flared free end 31. A second axle 46 extends from the crossbar 26 to the second foot section 44, wherein the second axle 46 is parallel to the second stem section 42 and perpendicular to the crossbar 26.

The first axle 36 and the second axle 46 can be set into the bracket 24. However, in the shown embodiment, the first axle 36 and the second axle 46 are the arms of a generally U-shaped pin 50 that interconnects with the bracket 24. In this manner, the bracket 24 can readily be molded of plastic, while the U-shaped pin 50 is made of stronger metal. The interconnection of the U-shaped pin 50 with the bracket 24 enables the metal pin 50 to reinforce the structural integrity of the plastic bracket 24. Holes 52 are formed in the crossbar 26 and in the foot sections 34, 44 to accommodate the passage of the first axle 36 and the second axle 46 of the U-shaped pin 50.

A first guide pulley 54 rotates freely about the first axle 36. The first guide pulley 54 is sized and shaped to engage the elastic loop 20. Likewise, a second guide pulley 56 rotates freely about the second axle 46. The second guide pulley 56 is also sized and shaped to engage the elastic loop 20. A gap space 58 exists between the first foot section 34 of the first J-shaped arm 30 and the second foot section 44 of the second J-shaped arm 40. The flared free end 27 of the first foot section 34 and the flared free end 31 of the second foot section 44, create a tapered slot 48 that leads into the gap space 58. The tapered slot 48 guides the opposite sections of the elastic loop 20 into the loop connector assembly 22. The shape of the tapered slot 48 also helps prevent the elastic loop 20 from inadvertently exiting the loop connector assembly 22 should the elastic loop 20 become slack. Once guided into the gap space 58, any tension in the elastic loop 20 will cause the opposite sections of the elastic loop 20 to pull against both the first guide pulley 54 and the second guide pulley 56.

The manner in which the elastic loop 20 engages the rebound mat 12 and the frame ring 16 depends upon the structure adopted for theses components. Referring back to FIG. 1, it can be seen that attachment features in the form of D-rings 60 are provided. The D-rings 60 are attached to short straps 62 that are sewn to the periphery of the rebound mat 12. Each D-ring 60 supports a free-spinning mat guide pulley 64. Likewise, attachment features in the form of metal loops 64 are affixed to the inside of the frame ring 16. The metal loops 65 support free-spinning frame guide pulleys 66. One loop section 68 of the elastic loop 20 is extended through the mat guide pulley 64 on the D-ring 60. An opposite section 70 of the elastic loop 20 is advanced through the frame guide pulley 66 on the metal loop 65. The two sections 68, 70 of the elastic loop 20 are then joined together using the loop connector assembly 22. In this attachment configuration, the elastic loop 20 only contacts guide pulleys 54, 56, 64, 66. In this manner, as the elastic loop 20 elongates and contracts, the elastic loop 20 rotates the guide pulleys 54, 56, 64, 66 and does not wear against any surface. This greatly increases the functional life of the elastic loops 20.

Furthermore, the elastic loops 20 engage the loop connector assembly 22 by simply advancing the opposite sections 68, 70 into the tapered slot 48. The elastic loops 20 are removed from the loop connector assembly 22 by being manipulated out of the tapered slot 48 in reverse. Accordingly, the elastic loops 20 can be quickly detached from the assembly of the overall trampoline 10. Likewise, the elastic loops 20 can be easily and rapidly replaced with new elastic loops or elastic loops of different strengths and/or lengths. This enables a user to maintain the trampoline 10 or selectively increase or decrease the bounce of the trampoline 10 for users of different skill levels and/or body weights.

Figure 4:
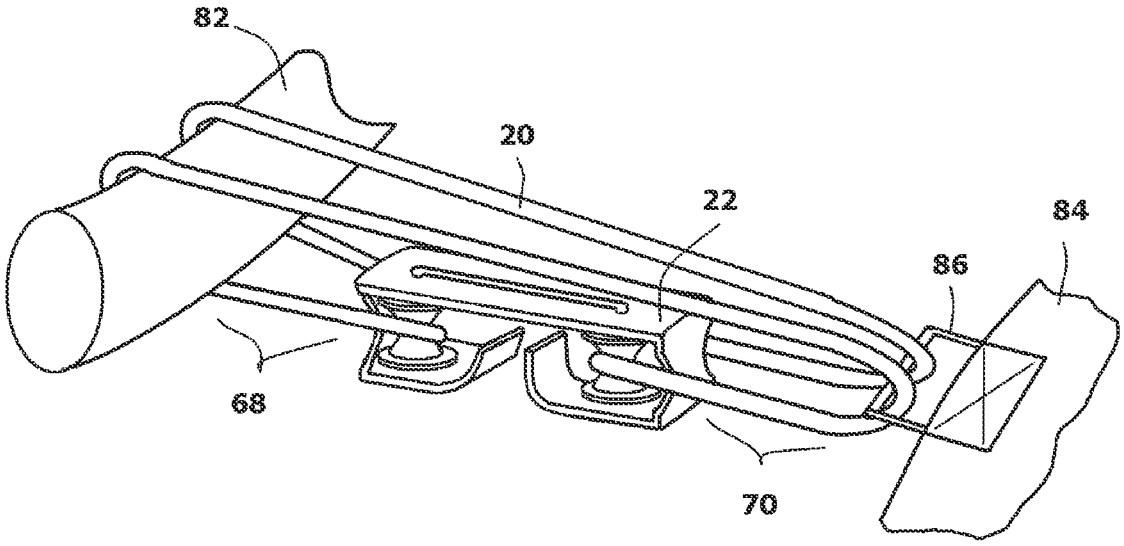
FIG. 4 shows an enlarged view of an alternate connection system used to connect a rebound mat to a peripheral frame.
Figure 5:
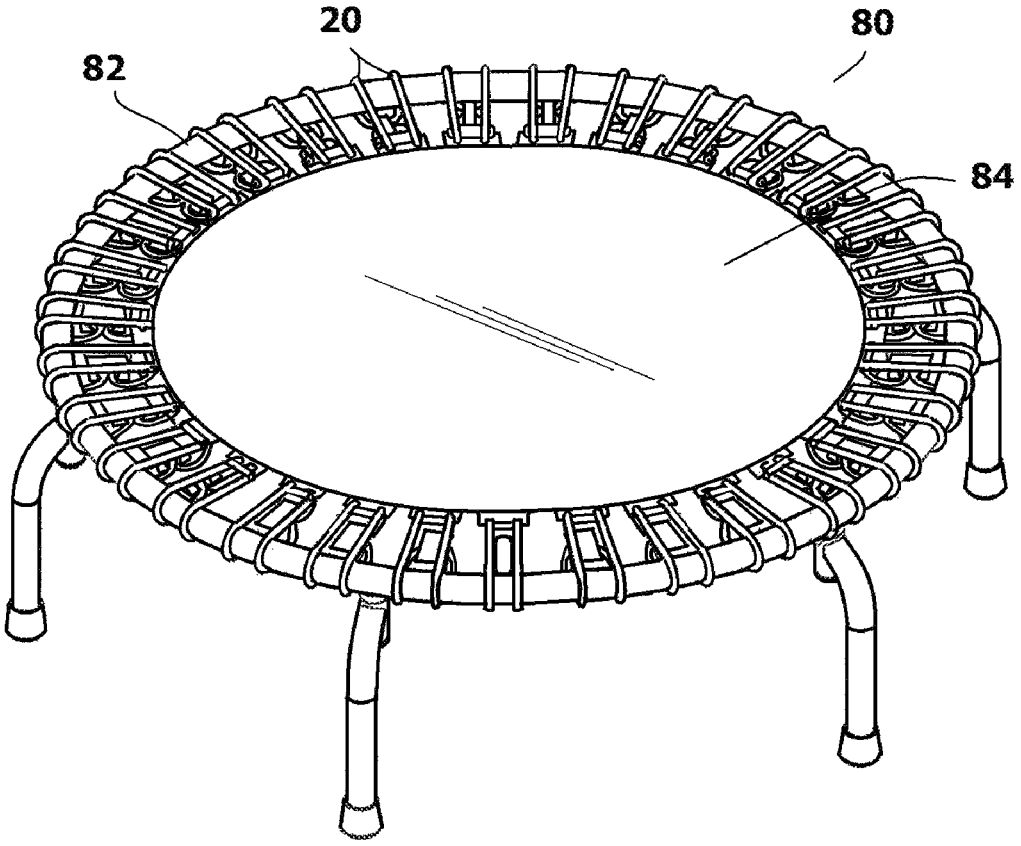
FIG. 5 shows a full trampoline assembly embodying the connection system shown in FIG. 4.

Referring to FIG. 4 and FIG. 5, it will be understood that the elastic loops 20 and loop connection assembly 22 can be retroactively added to many prior art trampolines 80. Many prior art trampolines 80 have frame rings 82 that are smooth. Many also have jumping mats 84 with D-rings 86 but no guide pulley. Using such prior art equipment, the first loop section 68 of the elastic loop 20 can be extended around the frame ring 82. The opposite section 70 of the elastic loop 20 can be extended through the D-ring 86. The two sections 68, 70 of the elastic loop 20 are then joined using the loop connection assembly 22.

It will be understood that the embodiments of the present invention that are illustrated and described are merely exemplary and that a person skilled in the art can make many variations to those embodiments. For instance, the peripheral shape and area of the trampoline can be changed as a matter of design choice. All such embodiments are intended to be included within the scope of the present invention as defined by the claims.

What is claimed is:

1. A method for attaching a rebound mat to a peripheral frame, comprising:

providing an elastic loop where a first section of said elastic loop can be stretched away from a second section of said elastic loop;

providing a loop connector having a first pulley wheel, a second pulley wheel, and a gap space disposed between said first pulley wheel and said second pulley wheel;

extending said first section around a first feature of said peripheral frame;

extending said second section around a second feature of said rebound mat; and joining said first section of said elastic loop and said second section of said elastic loop to said loop connector at a point between said rebound mat and said peripheral frame, wherein said first section rests on said first pulley wheel and said second section rests on said second pulley wheel.

2. The method of claim 1, wherein said first pulley wheel is free to rotate about a first axis and said second pulley is free to rotate about a second axis.

3. The method of claim 2, wherein said first axis of said first pulley wheel is parallel to said second axis of said second pulley wheel.

4. The method of claim 1, wherein said loop connector includes a slot that leads to said gap space between said first pulley wheel and said second pulley wheel, said method further includes advancing both said first section and said second section of said elastic loop into said loop connector through said slot.

5. The method of claim 1, wherein said loop connector includes a tapered slot that guides said first section and said second section of said loop structure into said gap space.

6. The method of claim 1, wherein extending said first section around a first feature of said peripheral frame includes extending said first section around a third pulley wheel that is anchored to said peripheral frame.

7. The method of claim 1, wherein extending said second section around a second feature of said rebound mat includes extending said second section around a fourth pulley wheel that is anchored to said rebound mat.

8. A connector assembly for attaching a rebound mat to a peripheral frame by connecting a first loop section to a second loop section of an elastic loop, said connector assembly comprising:

a crossbar with a first end and an opposite second end;

a first arm extending from said first end of said crossbar in a first direction;

a second arm extending from said second end of said crossbar in said first direction, wherein a slot exists between said first arm and said second arm;

a first axle that extends from said crossbar to said first arm;

a first pulley wheel that rotates freely about said first axle;

a second axle that extends from said crossbar to said second arm; and a second pulley wheel that rotates freely about said second axle.

9. The connector assembly of claim 8, wherein said first axle and said second axle are parallel.

10. The connector assembly of claim 9, wherein said first axle and said second axle are both parts of a common U-shaped pin structure that extends through holes formed in said crossbar.

11. The connector assembly of claim 10, wherein said crossbar, said first arm and said second arm are unistucturally molded from plastic and said U-shaped pin structure is formed of metal.

12. The connector assembly of claim 8, wherein said first arm and said second arm provide a tapered entrance to said slot.

13. The connector assembly of claim 8, wherein both said first arm and said second arm are J-shaped.

14. A rebound assembly comprising:

a rebound mat having a periphery;

a frame ring that surrounds said periphery of said rebound mat;

an elastic loop that extends between said rebound mat and said frame ring, wherein said elastic loop has a first section that can be stretched away from a second section; and a loop connector having a first pulley wheel and a second pulley wheel, wherein said loop connector receives said first section of said elastic loop and said second section of said elastic loop at a point between said rebound mat and said peripheral frame, wherein said first section contacts said first pulley wheel and said second section contacts said second pulley wheel.

15. The rebound assembly of claim 14, wherein said frame ring has a third pulley wheel anchored thereto and said first section of said elastic loop extends around said third pulley wheel.

16. The rebound assembly of claim 14, wherein said rebound mat has a third pulley wheel anchored thereto and said second section of said elastic loop extends around said third pulley wheel.

17. The rebound assembly of claim 14, wherein said first pulley wheel is free to rotate about a first axle and said second pulley is free to rotate about a second axle and wherein said first axle and said second axle are parallel.

18. The rebound assembly of claim 14, further including a tapered slot that leads between said first pulley wheel and said second pulley wheel.

* * * * *